US006655032B2

(12) United States Patent
Thompson et al.

(10) Patent No.: US 6,655,032 B2
(45) Date of Patent: Dec. 2, 2003

(54) PUMPKIN CUTTING APPARATUS

(76) Inventors: Vicki L. Thompson, 304 Falcon Ct., Silver Lake, KS (US) 66539; Tyler T. Harrell, P.O. Box 418, Ottawa, KS (US) 66067

( * ) Notice: Subject to any disclaimer, the term of this patent is extended or adjusted under 35 U.S.C. 154(b) by 25 days.

(21) Appl. No.: 10/135,604

(22) Filed: Apr. 30, 2002

(65) Prior Publication Data

US 2003/0200664 A1 Oct. 30, 2003

(51) Int. Cl.[7] ..... B26B 11/00

(52) U.S. Cl. ..... 30/130; 30/124; 30/128; 30/280

(58) Field of Search ..... 30/315, 124, 130, 30/280, 278, 279.2, DIG. 7, 368, 314, 316, 305, 128; 83/167, 588, 684; 220/738, 611; 221/31, 64; 336/260, 332, 130, 143, 205, 255, 256, 333

(56) References Cited

U.S. PATENT DOCUMENTS

| | | | | | |
|---|---|---|---|---|---|
| 2,008,725 | A | * | 7/1935 | Parker | 30/130 |
| 2,415,976 | A | * | 2/1947 | Thorud | 30/130 |
| 2,720,176 | A | * | 10/1955 | Babbitt | 30/130 |
| 2,779,097 | A | * | 1/1957 | Frazier | 30/130 |
| 2,804,988 | A | * | 9/1957 | Dobbins, III | 220/611 |
| 2,872,958 | A | * | 2/1959 | Popeil | 241/272 |
| 3,053,203 | A | | 9/1962 | Gaddini | |
| 3,648,555 | A | * | 3/1972 | Schraud et al. | 83/167 |
| 3,786,564 | A | * | 1/1974 | Acheson | 30/124 |
| 3,965,574 | A | | 6/1976 | Graves | |
| 4,021,342 | A | * | 5/1977 | Schacht et al. | 210/94 |
| 4,296,659 | A | | 10/1981 | Nauman | |
| 4,689,885 | A | | 9/1987 | Albanese | |
| 4,738,195 | A | * | 4/1988 | Berube et al. | 99/591 |
| 4,832,131 | A | * | 5/1989 | Powell et al. | 172/25 |
| 4,843,716 | A | * | 7/1989 | Lutzker | 30/130 |
| 4,967,970 | A | * | 11/1990 | Michel | 241/169 |
| 5,778,541 | A | | 7/1998 | McClung | |
| 5,806,190 | A | | 9/1998 | Robitaille | |
| 5,933,968 | A | | 8/1999 | Solomon | |
| 6,125,776 | A | * | 10/2000 | Carmichael | 111/113 |
| 6,134,789 | A | * | 10/2000 | Strickland | 30/276 |
| 6,267,036 | B1 | | 7/2001 | Lani | |

* cited by examiner

*Primary Examiner*—Hwei-Siu Payer
(74) *Attorney, Agent, or Firm*—Dale J. Ream

(57) ABSTRACT

A pumpkin cutting apparatus includes a tubular shaft and a cutter releasably coupled to one end thereof, the cutter having a continuous side wall capable of cutting a pumpkin and retaining the cut portion. A plunger shaft extending through the tubular shaft and slides upwardly therethrough and extends through a top opening as the cutter cuts into a pumpkin. Once a cut is complete, the plunger shaft may be pushed back down into the tubular shaft so as to eject the cut portion from the cutter. The apparatus includes an elastomeric shell for surrounding and stabilizing a pumpkin. A transparent dome defining an aperture is selectively situated atop the shell. The tubular shaft and aperture have complementary threads so that the shaft may be rotated to force the cutter into the pumpkin, the cutter being rotatably coupled to the tubular shaft so as not to rotate therewith.

20 Claims, 8 Drawing Sheets

PUMPKIN CUTTING APPARATUS

BACKGROUND OF THE INVENTION

This invention relates generally to pumpkin carving devices and, more particularly, to a pumpkin carving apparatus which enables a child to carve a pumpkin while reducing the risk of being cut by a cutting blade.

Carving a pumpkin is traditional in the autumn season and especially at Halloween. While children desire to carve their own pumpkins, many parents are reluctant to allow children to use long, sharp knives without considerable assistance. The practical reality is that many children are unable to fulfill their desire to carve their own pumpkin until they are considerably older.

Many devices have been proposed in the art for cutting and carving pumpkins. Although assumably effective for their intended purposes, the existing devices do not. satisfy the safety concerns relative to a child operating sharp cutting tools, especially in use with an unstable, irregularly shaped pumpkin.

Therefore, it is desirable to have a pumpkin cutting apparatus which encloses a pumpkin and shields a user's hands from contact with any cutting edge. Further, it is desirable to have an apparatus which retains a cut portion such that the cut portion need not be separately removed from the pumpkin's interior. In addition, it is desirable to have an apparatus which utilizes rotational shaft actuation of the cutter such that a child is able to easily carve a pumpkin.

SUMMARY OF THE INVENTION

A pumpkin cutting apparatus according to the present invention includes a tubular shaft defining opposed first and second open ends and having a handle at the first end. A cutter is releasably coupled to the tubular shaft at the second end. The cutter includes a top wall with an inwardly sloping continuous side wall depending therefrom so as to define an open bottom and an interior cavity. A free edge of the side wall is the cutting edge for contact with the pumpkin. When a portion of the pumpkin has been completely cut, it is retained within the interior cavity of the cutter by the inwardly sloping side wall.

The apparatus also includes a plunger assembly for selectively ejecting a cut pumpkin portion from the interior cavity of the cutter, such as after the cutter and cut portion have been removed through the same hole from which it was cut. The plunger assembly includes a plunger shaft that is longer than the tubular shaft and which extends therethrough and through the cutter. Therefore, as the cutter is pressed against a pumpkin surface and a cut pumpkin portion is gradually received into the interior cavity, the plunger shaft is correspondingly moved upwardly through the tubular shaft with a plunger head eventually extending from the first open end of the tubular shaft. Once the cutter is removed back through the cut hole, the plunger head member may be pushed back down so as to eject the cut portion. The plunger shaft may be spring loaded so as to assist in the ejection.

The apparatus includes a base assembly having an elastomeric base shell that may be placed around a pumpkin to keep it stable during carving. A transparent dome cover may be releasably coupled to the shell in a tongue and groove arrangement. The dome defines an aperture at its apex through which the tubular shaft may extend. The dome allows a child to clearly view the pumpkin he is carving while protecting his hands from inadvertent contact with the cutter. The aperture and tubular shaft may have complementary threads such that the cutter is pressed deeper into the pumpkin as the shaft is rotated. The cutter is rotatably coupled in the tubular shaft such that the cutter may maintain a stationary cutting position on the pumpkin even during tubular shaft rotation.

Therefore, a general object of this invention is to provide an apparatus for carving a pumpkin which holds a pumpkin in a stable position while carving it.

Another object of this invention is to provide an apparatus, as aforesaid, having a cutter which retains a portion cut from a pumpkin for post-removal ejection.

Still another object of this invention is to provide an apparatus, as aforesaid, which encloses a pumpkin under a transparent cover and separates a user's hands from the cutter so as to prevent injury.

A further object of this invention is to provide an apparatus, as aforesaid, which allows a child to actuate the cutter with an easy rotational action.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
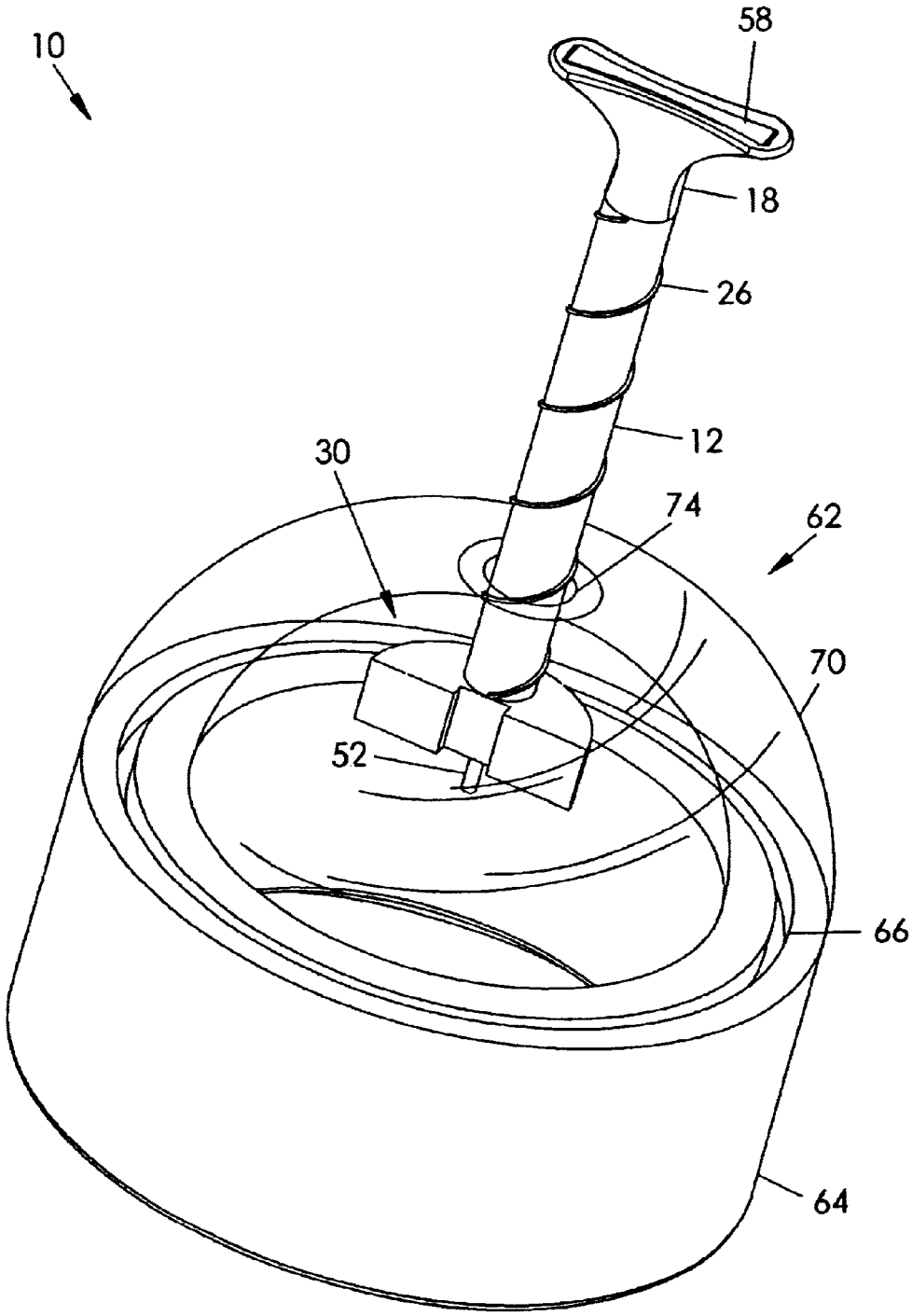
FIG. 1 is a perspective view of a pumpkin carving apparatus in a ready configuration according to one embodiment of the present invention.
Figure 2:
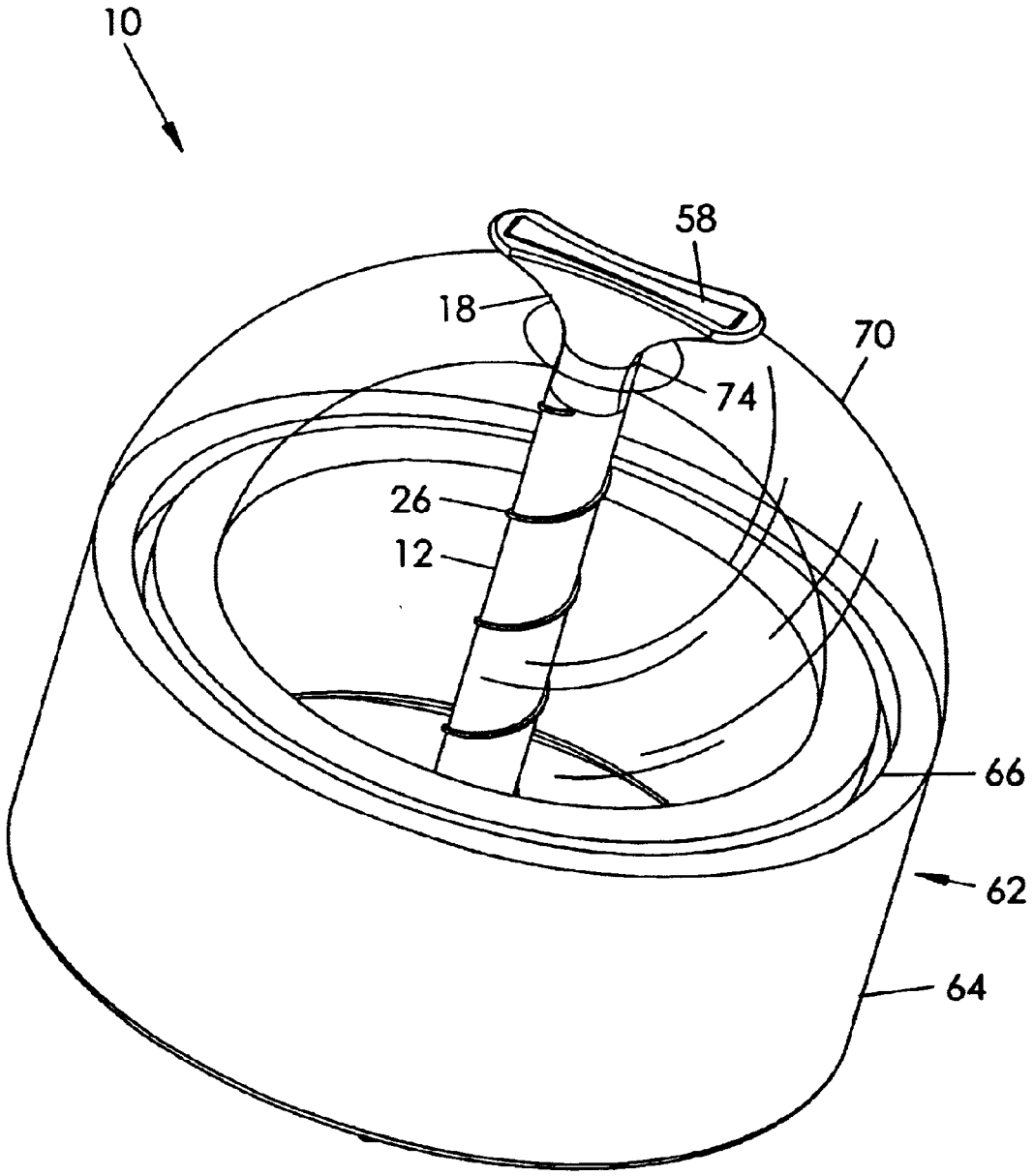
FIG. 2 is a perspective view of the apparatus as in FIG. 1 in a use configuration.
Figure 8:
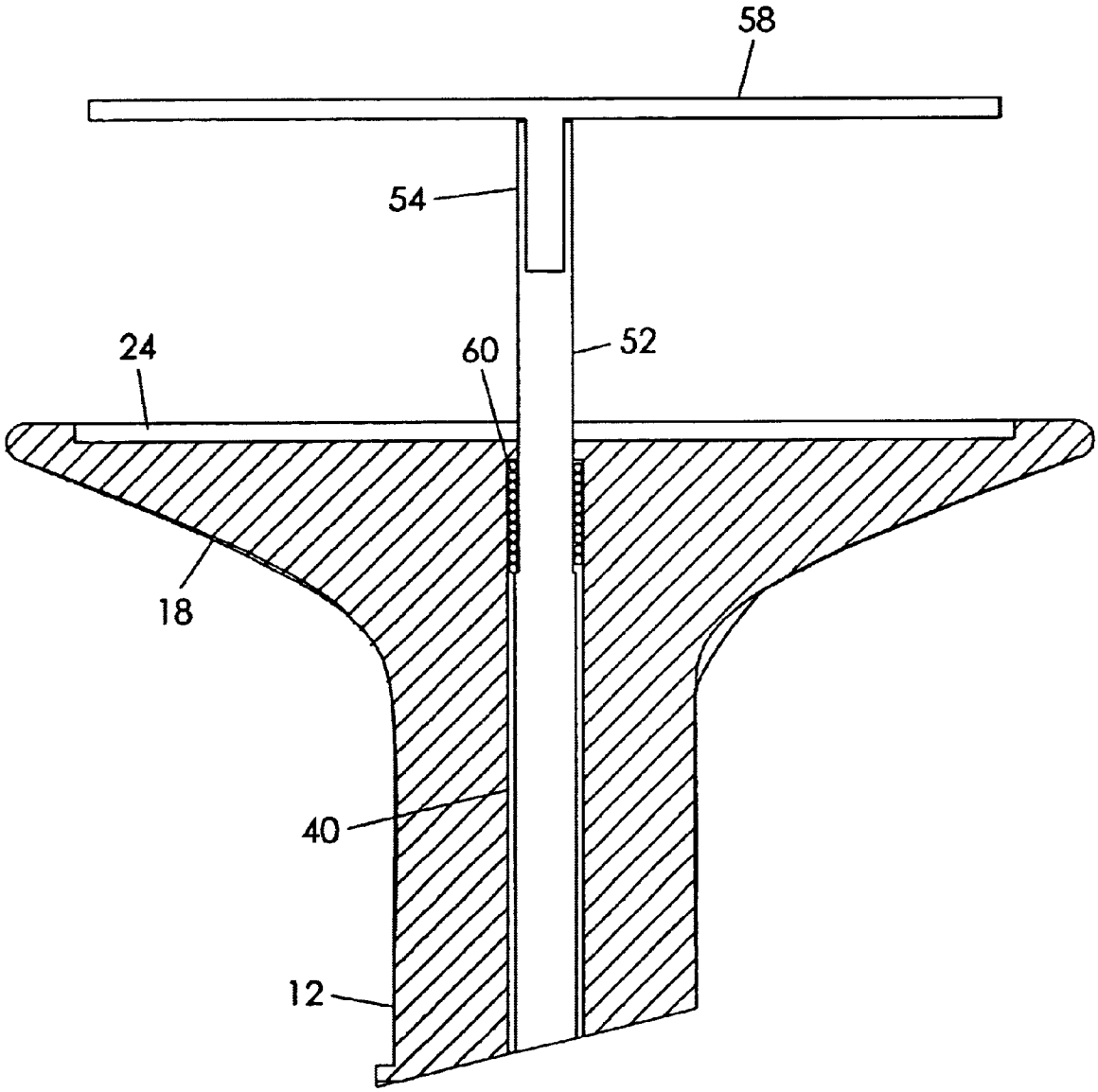
FIG. 8 is a sectional view as in FIG. 5 with the plunger assembly in a puncture configuration.

A pumpkin cutting apparatus according to the present invention will now be described in detail with reference to FIGS. 1 through 8 of the accompanying drawings. A pumpkin cutting apparatus 10 according to one embodiment includes an elongate tubular shaft 12 having first 14 and second 20 opposed ends defining respective first 16 and second 22 openings. Although another embodiment of a tubular shaft is shown in FIG. 6 and which will be described in more detail later, FIG. 6 serves to illustrate the opening in the first end 14 of a tubular shaft. Further, the first end 14 of the tubular shaft 12 forms a handle 18 having a generally narrow configuration that may be gripped by a user (FIGS. 1 and 2). A top surface of the handle 18 is perpendicular to the tubular shaft 12 and defines a recess 24 extending between laterally opposed ends thereof (FIGS. 6 and 8).

The pumpkin cutting apparatus 10 further includes a cutter 30 having a planar top wall 32 defining a continuous peripheral edge thereabout (FIG. 1). A continuous side wall 34 depends from the peripheral edge and terminates at a continuous free edge 36. Therefore, the cutter 30 includes an open bottom, the top and side walls defining an interior cavity. The side wall 34 is inwardly sloped between the peripheral edge of the top wall 32 and the free edge 36 of the side wall 34. This draft angle enables a cut portion of a pumpkin or other gourd to be retained within the interior cavity, as to be described more fully below. The top 32 and side 34 walls may be formed in various configurations, such as a triangle 38*a*, silly face 38*b*, scary face 38*c*, or happy face 38*d*, shown as first through fourth cutters in FIGS. 7*a*–7*d*, respectively. Cutters having various configurations may be included with the present invention as a kit.

Figure 4:
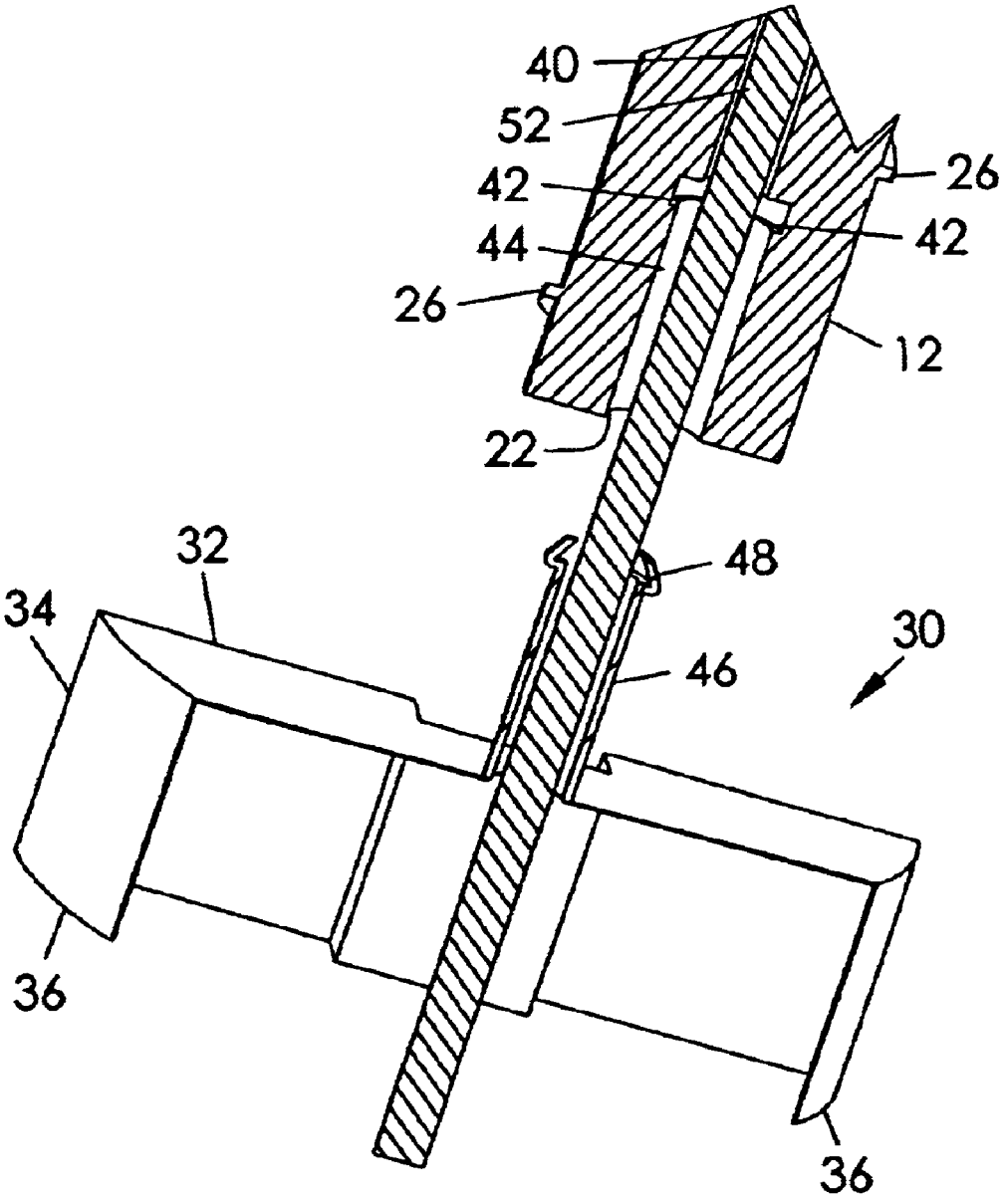
FIG. 4 is a sectional view taken along line 4—4 of FIG. 3.

The tubular shaft 12 defines a tubular channel 40 extending between the open shaft ends (FIG. 4). A retaining ledge 42 extends peripherally about the inner surface of the tubular channel 40 although the ledge 42 does not present a blockage or enclosure (FIG. 4). The ledge 42 is spaced from the second open end 22 of the tubular shaft 12 and is situated within a lower portion 44 of the channel 40, the lower portion 44 having a diameter greater than a diameter of the remainder of the tubular channel 40. The cutter 30 includes a pair of arms 46 fixedly attached to and extending upwardly from the top wall 32 thereof. Each arm 46 includes a free end having a retaining lip 48 having an elbow configured to releasably engage the retaining ledge 42 in a snap-fit relationship. The arms 46 are constructed of a resilient plastic material such that the arms 46 may be released from a snappable engagement with the ledge 42 when squeezed together by a user. Of course, the arms 46 could have a thin metal or other suitable construction. It should be appreciated that when the retaining lips 48 are engaged/retained upon the retaining ledge 42, they are free to rotate atop the ledge 42 as the cutter 30, to which the arms 46 are fixedly attached, is rotated. Thus, the cutter 30 is both releasably and rotatably coupled to the tubular shaft 12 such that the cutter 30 may be held stationary while the tubular shaft 12 is rotated in a cutting operation, as to be described in further detail below.

The pumpkin cutting apparatus 10 further includes a plunger assembly such that a cut portion of a pumpkin may be selectively expelled from the interior cavity of the cutter 30. More particularly, an elongate-plunger shaft 52 extends through the channel 40 of the tubular shaft 12 and through the cutter 30 (when the cutter is coupled to the tubular shaft). Thus, the plunger shaft 52 presents a length that is greater than a length of the tubular shaft 12. The plunger shaft 52 includes opposed upper 54 and lower 56 ends, the upper end having a plunger head 58 that may be selectively depressed by a user (FIG. 8). The plunger head 58 presents a configuration complementary to that of the recess 24 of the tubular shaft handle 18. The plunger shaft 52 is slidably movable between an ejection configuration and a puncture configuration. In the puncture configuration, the lower end 56 of the plunger shaft 52 is flush with the top wall 32 of the cutter 30 and the upper end 54 and plunger head 58 are upwardly displaced from the first opening 16 of the tubular shaft 12. The puncture configuration exists where the cutter 30 has been pressed into a pumpkin. As the cut portion incrementally fills the interior cavity, the plunger shaft 52 is pushed slidably thereby such that the plunger head 58 extends upwardly above the tubular shaft 12 (FIG. 8).

Figure 5:
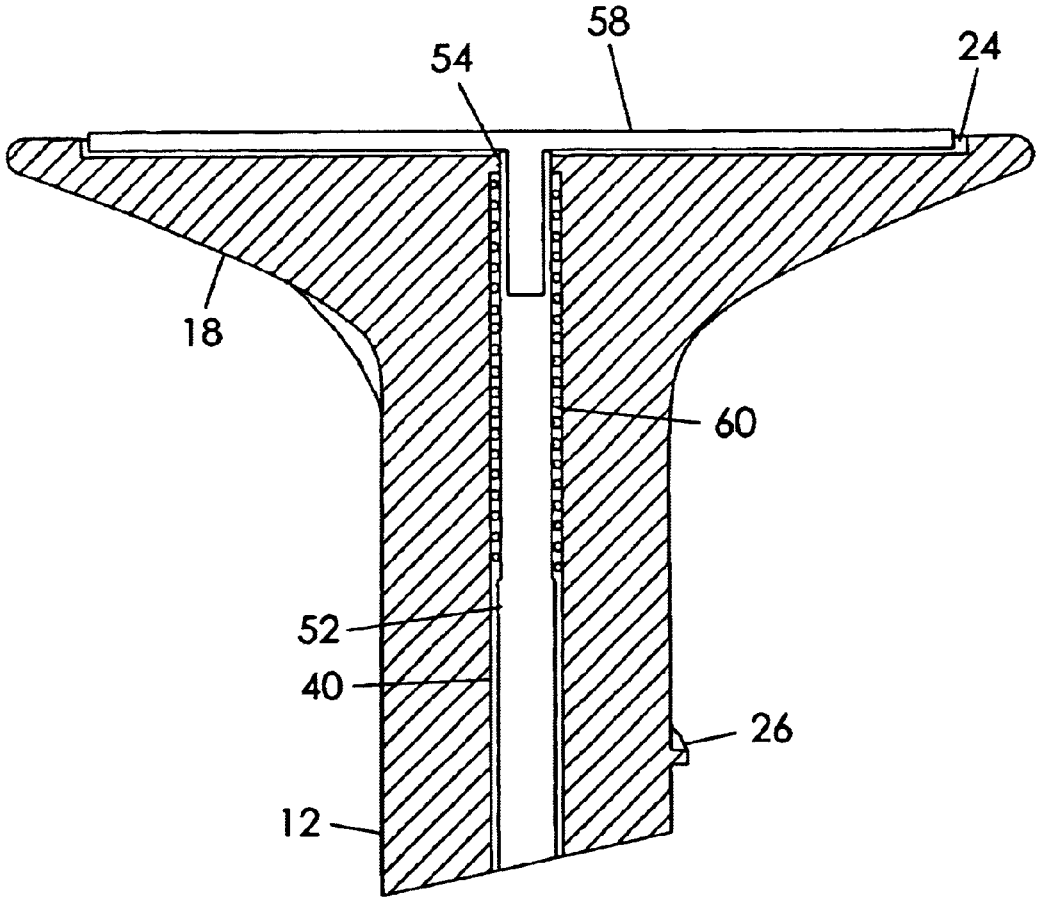
FIG. 5 is a sectional view taken along line 5—5 of FIG. 3 with the plunger assembly in an ejection configuration.
Figure 6:
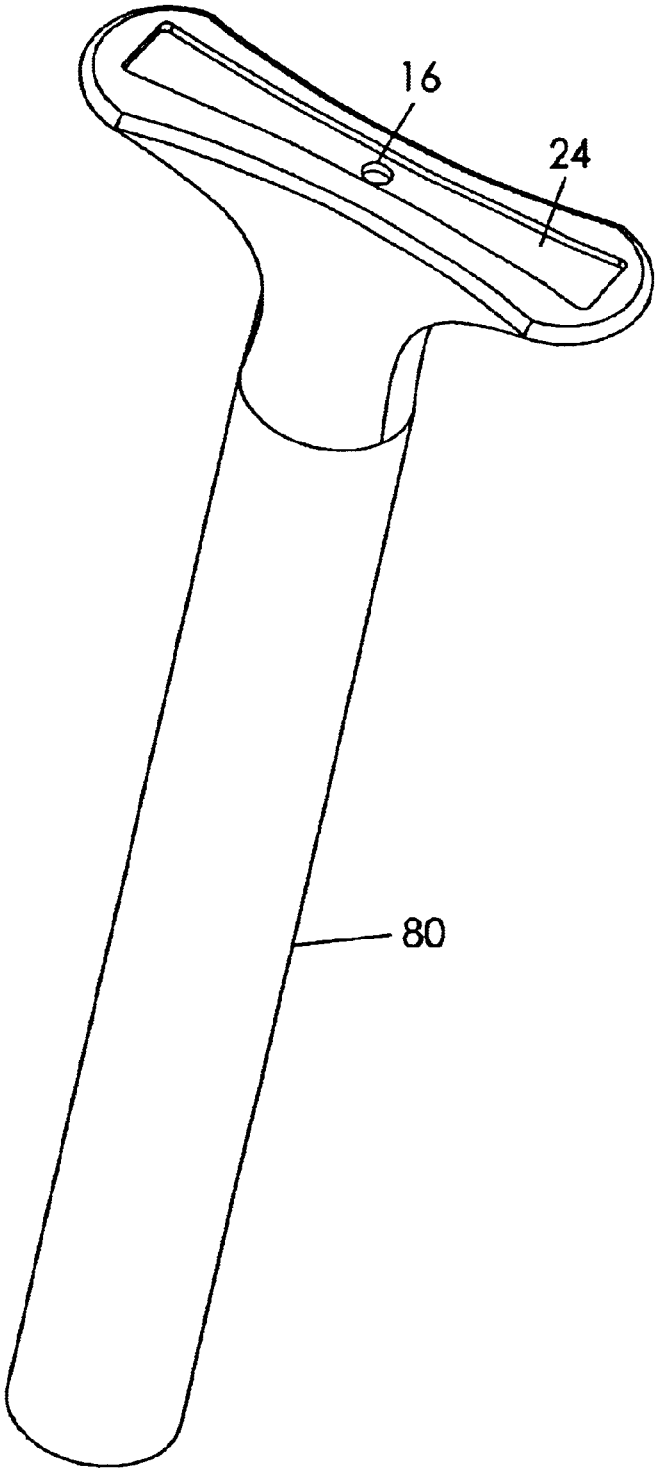
FIG. 6 is a perspective view of a tubular shaft of a pumpkin cutting apparatus according to another embodiment of the present invention.
Figure 7A:
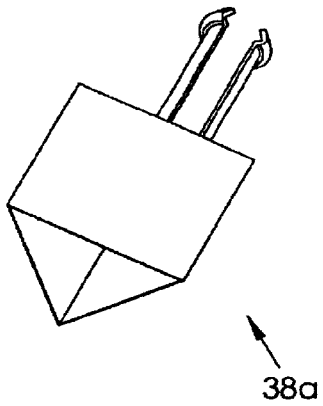
FIG. 7*a* is a perspective view of a first cutter.
Figure 7B:
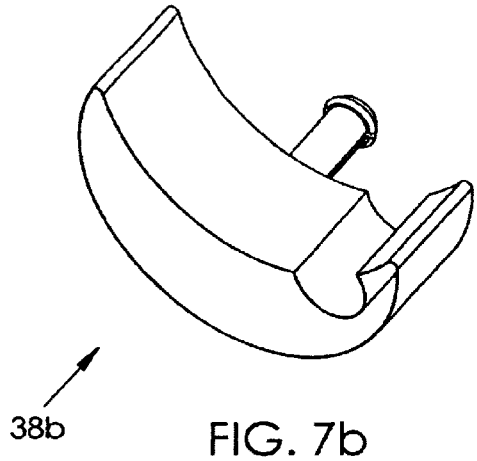
FIG. 7*b* is a perspective view of a second cutter.
Figure 7C:
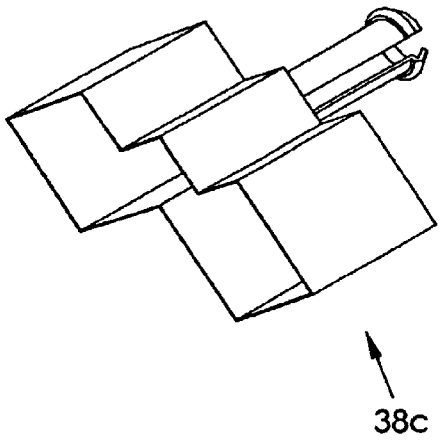
FIG. 7*c* is a perspective view of a third cutter.
Figure 7D:
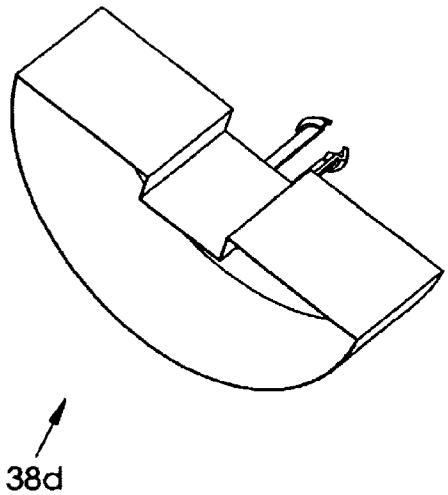
FIG. 7*d* is a perspective view of a fourth cutter.

The plunger head 58, once extended by the cutter's retention of a cut portion, may be pushed down until it rests flush within the recess 24 of the tubular shaft handle 18 (FIG. 5). The lower end 56 of the plunger shaft 52 is downwardly displaced from the top wall 32 of the cutter 30 in this configuration, this downward movement ejecting a cut portion from retention within the interior cavity.

As shown in FIGS. 5 and 8, the plunger assembly may also include a compression spring 60 situated within the tubular channel 40 of the tubular shaft 12. Preferably, the compression spring 60 is positioned adjacent the first opening 16 at the first end 14 of the tubular shaft 12. The spring 60 presents a diameter greater than a diameter of the first opening 16 such that the spring is retained in the channel 40. Of course, other conventional retention means may also be employed. The plunger shaft 52 includes a configuration adapted to compress the spring 60 as the plunger shaft 52 is moved upwardly, i.e. from an ejection configuration (FIG. 5) to a puncture configuration (FIG. 8). Accordingly, the plunger shaft 52 is urged by the spring 60 toward the ejection configuration and thus assists a user in ejecting a cut portion from the interior cavity of the cutter 30.

Figure 3:
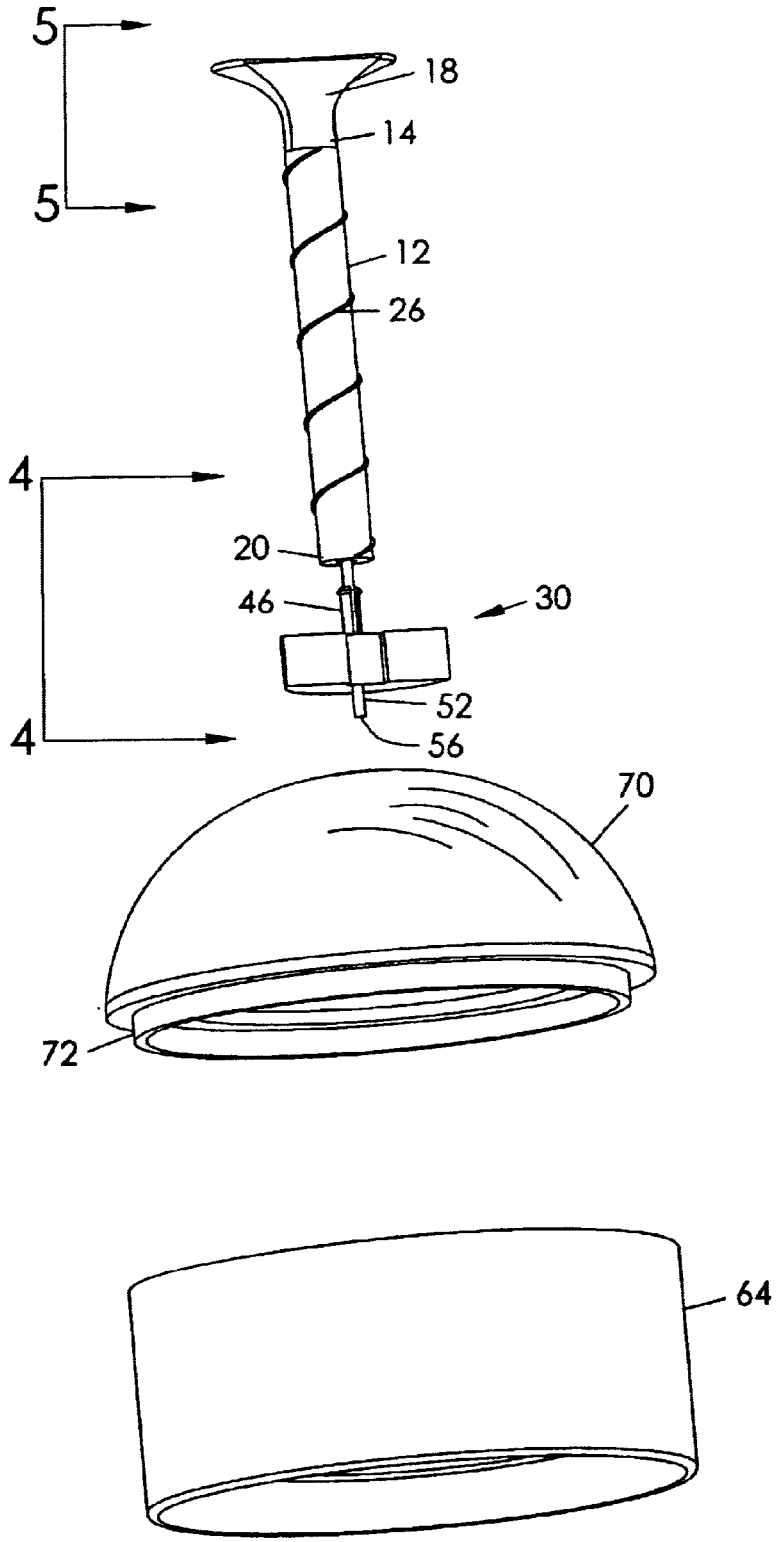
FIG. 3 is an exploded view of the apparatus as in FIG. 1.

The pumpkin cutting apparatus 10 further includes a base assembly 62 having a shell 64 and a cover 70. More particularly, the shell 64 includes a generally cylindrical configuration defining an open top and open bottom and being constructed of an elastomeric material. This construction enables the shell 64 to be positioned over a pumpkin having an irregular shape, the resilient material allowing the shell to conform to shape irregularities and to hold the pumpkin stationary during operation of the cutting components. The shell 64 includes a top surface defining a groove 66 peripherally thereabout (FIG. 2). The cover 60 includes a dome or hemispherical configuration having a free edge defining an open bottom (FIG. 3). Preferably, the cover 70 is constructed of a transparent material, such as clear plastic, so that a user may view what is held within the shell 64. A continuous tongue member 72 depends from the free edge of the cover and includes a configuration complementary to that of the groove 66 such that the cover 70 may be selectively retained atop the shell 64 in a tongue and groove engagement.

The cover 70 defines a circular aperture 74 at its apex, the aperture 74 having a diameter complementary to a diameter of the tubular shaft 12 so as to selectively receive the tubular shaft therethrough. In this embodiment, the tubular shaft 12 includes a plurality of threads 26 extending spirally thereabout between the first 14 and second 20 ends. The cover 70 includes a plurality of threads (not shown) about the aperture 74 that are complementary to threads 26 of the tubular shaft 12 such that the tubular shaft 12 may be moved downwardly or upwardly relative to the cover 70 upon a respective clockwise or counterclockwise rotation of the tubular shaft 12.

In use, the shell 64 may be placed over a pumpkin or other gourd to be carved. The shell 64 may stretch to accommodate pumpkins of irregular shape and size so as to hold a pumpkin in a stable position during use. The cover 70 may then be placed atop the shell 64 in tongue and groove engagement so as to enclose the pumpkin there under. The tubular shaft 12, with cutter 30 released therefrom, may be inserted through the cover aperture 74 (FIG. 1). The cutter 30, when rotatably coupled to the tubular shaft 12, may be positioned so as to bear against the pumpkin at a desired location to be carved. An appropriate rotation of the tubular shaft 12 applies downward pressure upon the cutter 30, thus causing the free edge 36 of the cutter side wall 34 to cut into the pumpkin. The cutter 30 itself remains stationary at the desired cutting position due to the rotatable coupling of the arms 46 within the tubular shaft 12 (FIG. 4).

As the cutter 30 is incrementally pushed deeper in a cutting operation, the cut portion of the pumpkin bears against the lower end 56 of the plunger shaft 52, causing the plunger shaft 52 to move slidably upwardly through the channel 40 of the tubular shaft 12. When the cutting operation is complete, the plunger head 58 will be extended in a FIG. 8 configuration (the puncture configuration). The tubular shaft 12 may then be rotated in an opposite direction whereby to remove the cutter 30 from the carved hole. Then, the plunger head 58 may be pushed back down by a user, aided by the spring 60, to the FIG. 5 configuration (the ejection configuration). This action ejects the cut portion from the interior cavity of the cutter 30. This process may be repeated in order to carve multiple holes. The cutter 30 may be removed and replaced with other of the FIGS. 7*a*–7*d* cutters, as desired.

In an alternative embodiment of the present invention, a tubular shaft 80 having no threads may be utilized with the previously described apparatus. Otherwise, the alternative tubular shaft 80 includes a construction substantially similar to the construction of the tubular shaft 12 described previously. This tubular shaft 80 is shown in FIG. 6 with the plunger shaft removed. In this embodiment, the aperture of the cover is also unthreaded (not shown). Therefore, this tubular shaft 80 must be manually pressed in a downward direction to push a cutter into a pumpkin or other gourd.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A pumpkin cutting apparatus, comprising:

a tubular shaft having opposed first and second ends defining first and second openings, respectively;

a cutter having a top wall and a continuous side wall depending from said top wall, said side wall including a continuous free edge defining an open bottom and capable of cutting into a pumpkin, said top wall and said side wall defining an interior cavity adapted to receive a cut portion of said pumpkin;

means for releasably coupling said cutter to said first end of said tubular shaft;

a plunger assembly including an elongate plunger shaft having upper and lower ends and extending longitudinally through said tubular shaft, said plunger shaft having a length greater than a length of said tubular shaft and adapted to move slidably therein between an ejection configuration and a puncture configuration; and a flexible shell having a generally cylindrical configuration and defining an open top and an open bottom, said shell adapted to be positioned over said pumpkin and substantially conform to the contour thereof.

2. The pumpkin cutting apparatus as in claim 1 wherein:

in said ejection configuration, said lower end of said plunger shaft extends through and is downwardly displaced from said top wall of said cutter, and said upper end of said plunger shaft is flush with said second opening of said tubular shaft; and in said puncture configuration, said lower end of said plunger shaft is flush with said top wall of said cutter and said upper end of said plunger shaft extends through and is upwardly displaced from said second opening of said tubular shaft.

3. The pumpkin cutting apparatus as in claim 1 wherein:

said top wall of said cutter defines a continuous peripheral edge from which said side wall depends, said side wall sloping inwardly between said top wall and said free edge so as to retain said cut portion within said interior cavity; and said continuous free edge being situated opposite said continuous peripheral edge and generally parallel thereto.

4. The pumpkin cutting apparatus as in claim 1 wherein said shell is constructed of an elastomeric material having a top surface that defines a groove peripherally thereabout; said pumpkin cutting apparatus further comprising:

a cover constructed of a transparent material and having a generally dome-shaped configuration, said cover having a tongue extending about a free edge thereof adapted to releasably mate with said groove of said shell, whereby to selectively enclose said pumpkin, said cover defining an aperture through which said tubular shaft may extend.

5. The pumpkin cutting apparatus as in claim 4 wherein:

said tubular shaft includes a plurality of threads extending spirally about an outer surface thereof between said first and second ends thereof;

said cover includes a plurality of threads extending about said aperture that are complementary to said threads of said tubular shaft such that said tubular shaft is adapted to move in a downward or upward direction relative to said cover upon a respective clockwise or counterclockwise rotation of said shaft in said aperture;

said pumpkin cutting apparatus further comprising means for rotatably coupling said cutter to said tubular shaft, whereby said cutter is adapted to maintain a fixed position bearing against said pumpkin while said tubular shaft is downwardly rotated.

6. The pumpkin cutting apparatus as in claim 1 wherein said plunger assembly includes means for urging said plunger shaft toward said ejection configuration, said urging means including a compression spring situated within said tubular shaft adjacent said second opening and having a diameter larger than a diameter of said second opening, said spring being connected to said plunger shaft so as to be compressed when said plunger shaft is moved toward said puncture configuration.

7. The pumpkin cutting apparatus as in claim 1 wherein:

said second of said tubular shaft includes a handle, said handle including a top surface defining a recess; and said plunger assembly includes a plunger head fixedly attached to said upper end of said plunger shaft, said plunger head having a configuration complementary to a configuration of said recess such that said plunger head rests within said recess when said plunger shaft is at said ejection configuration.

8. A pumpkin cutting apparatus, comprising:

a tubular shaft having opposed first and second ends defining first and second openings, respectively;

a cutter having a top wall and a continuous side wall depending from said top wall, said side wall including a continuous free edge defining an open bottom and capable of cutting into a pumpkin, said top wall and said side wall defining an interior cavity adapted to receive a cut portion of said pumpkin;

means for releasably coupling said cutter to said first end of said tubular shaft;

a plunger assembly including an elongate plunger shaft having upper and lower ends and extending longitudinally through said tubular shaft, said plunger shaft having a length greater than a length of said tubular shaft and adapted to move slidably therein between an ejection configuration and a puncture configuration;

a base assembly having a shell and a cover situated atop said shell, said shell having a generally cylindrical configuration defining an open top and an open bottom, said shell being adapted to be positioned over said pumpkin so as to minimize movement thereof; and wherein said cover is constructed of a transparent material and defines a generally dome-shaped configuration, said cover defining an aperture through which said tubular shaft may extend.

9. The pumpkin cutting apparatus as in claim 8 wherein:

said shell is constructed of an elastomeric material, said shell including a top surface that defines a groove peripherally thereabout;

said cover includes a tongue depending from a free edge thereof adapted to releasably mate with said groove of said shell, whereby to selectively enclose said pumpkin within said base assembly.

10. The pumpkin cutting apparatus as in claim 8 wherein said means for releasably coupling said cutter to said first end of said tubular shaft includes:

a ledge extending peripherally about an inner wall of said tubular shaft and displaced from said first end thereof; and a pair of arms extending upwardly from said top wall of said cutter, each arm having a free end configured to be retained upon said ledge, said pair of arms having a resilient construction such that said pair of arms are released from said ledge when urged together.

11. The pumpkin cutting apparatus as in claim 8 wherein:

said tubular shaft includes a plurality of threads extending spirally about an outer surface thereof between said first and second ends thereof;

said cover includes a plurality of threads extending about said aperture that are complementary to said threads of said tubular shaft such that said tubular shaft is adapted to move in a downward or upward direction relative to said cover upon a respective clockwise or counter-clockwise rotation of said shaft in said aperture; and said pumpkin cutting apparatus further comprising means for rotatably coupling said cutter to said tubular shaft, whereby said cutter is adapted to maintain a fixed position when bearing against said pumpkin while said tubular shaft is downwardly rotated.

12. The pumpkin cutting apparatus as in claim 11 wherein said means for rotatably coupling said cutter to said tubular shaft includes:

a ledge extending peripherally about an inner wall of said tubular shaft and displaced from said first end thereof; and a pair of arms extending upwardly from said top wall of said cutter, each arm having a free end configured to be retained upon said ledge and adapted to slide freely thereupon.

13. The pumpkin cutting apparatus as in claim 8 wherein said plunger assembly includes means for urging said plunger shaft toward said ejection configuration, said urging means including a compression spring situated within said tubular shaft adjacent said second opening and having a diameter larger than a diameter of said second opening, said spring being situated relative to said plunger shaft so as to be compressed thereby when said plunger shaft is moved toward said puncture configuration.

14. The pumpkin cutting apparatus as in claim 13 wherein:

said second end of said tubular shaft forms a handle, said handle including a top surface defining a recess; and said plunger assembly includes a plunger head fixedly attached to said upper end of said plunger shaft, said plunger head having a configuration complementary to a configuration of said recess such that said plunger head rests within said recess when said plunger shaft is at said ejection configuration.

15. The pumpkin cutting apparatus as in claim 8 wherein said side wall of said cutter slopes inwardly between said top wall and said free edge so as to retain said cut portion within said interior cavity of said cutter.

16. The pumpkin cutting apparatus as in claim 8 wherein:

in said ejection configuration, said lower end of said plunger shaft extends through and is downwardly displaced from said top wall of said cutter, and said upper end of said plunger shaft is flush with said second opening of said tubular shaft; and in said puncture configuration, said lower end of said plunger shaft is flush with said top wall of said cutter, and said upper end of said plunger shaft extends through and is upwardly displaced from said second opening of said tubular shaft.

17. A pumpkin cutting apparatus, comprising:

a tubular shaft having opposed first and second ends defining first and second openings, respectively, said tubular shaft including a plurality of threads extending spirally about an outer surface thereof between said first and second ends;

a cutter having a top wall and a continuous side wall depending from said top wall, said side wall including a continuous free edge defining an open bottom and capable of cutting into a pumpkin, said top wall and said side wall defining an interior cavity adapted to receive a cut portion of said pumpkin, said side wall being sloped inwardly between said top wall and said free edge so as to retain said cut portion in said interior cavity;

means for releasably coupling said cutter to said first end of said tubular shaft;

a plunger assembly including an elongate plunger shaft having upper and lower ends and extending longitudinally through said tubular shaft, said plunger shaft having a length greater than a length of said tubular shaft and adapted to move slidably therein between an ejection configuration and a puncture configuration;

a base assembly having a shell and a cover situated atop said shell, said shell having a generally cylindrical configuration defining an open top and an open bottom and having a top surface defining a groove peripherally thereabout, said shell being adapted to be positioned over said pumpkin so as to minimize movement thereof;

wherein said cover is constructed of a transparent material and defines a generally dome-shaped configuration having a free edge defining an open bottom, said cover having a tongue depending from said free edge thereof and having a configuration that is complementary to a configuration of said groove for releasably situating said cover atop said shell, said cover defining an aperture through which said tubular shaft may extend;

wherein said cover includes a plurality of threads extending about said aperture that are complementary to said threads of said tubular shaft such that said tubular shaft is adapted to move in a downward or upward direction relative to said cover upon a respective clockwise or counterclockwise rotation of said shaft in said aperture; and said pumpkin cutting apparatus further comprising means for rotatably coupling said cutter to said tubular shaft, whereby said cutter is adapted to maintain a fixed position when bearing against said pumpkin while said tubular shaft is downwardly rotated.

18. The pumpkin cutting apparatus as in claim 17 wherein:

in said ejection configuration, said lower end of said plunger shaft extends through and is downwardly displaced from said top wall of said cutter and said upper end of said plunger shaft is flush with said second opening of said tubular shaft; and in said puncture configuration, said lower end of said plunger shaft is flush with said top wall of said cutter, and said upper end of said plunger shaft extends through and is upwardly displaced from said second opening of said tubular shaft.

19. The pumpkin cutting apparatus as in claim 17 wherein said shell is constructed of an elastomeric material adapted to completely surround said pumpkin so as to minimize movement thereof.

20. The pumpkin cutting apparatus as in claim 17 wherein said plunger assembly includes means for urging said plunger shaft toward said ejection configuration, said urging means including a compression spring situated within said tubular shaft adjacent said second opening and having a diameter larger than a diameter of said second opening, said spring being situated relative to said plunger shaft so as to be compressed thereby when said plunger shaft is moved toward said puncture configuration.

* * * * *